United States Patent [19]

Kondoh

[11] Patent Number: 4,562,713

[45] Date of Patent: Jan. 7, 1986

[54] COLD PILGER MILL

[75] Inventor: Yukio Kondoh, Osaka, Japan

[73] Assignee: Sumitomo Metal Industries, Ltd., Japan

[21] Appl. No.: 561,355

[22] Filed: Dec. 14, 1983

[51] Int. Cl.[4] ..... B21B 37/00; B21B 21/04

[52] U.S. Cl. ..... 72/24; 72/21; 72/214; 72/250; 414/431

[58] Field of Search ..... 414/431; 72/21, 22, 72/23, 24, 214, 250

[56] References Cited

U.S. PATENT DOCUMENTS

| | | | |
|---|---|---|---|
| 3,344,644 | 10/1967 | Fahrenholz | 72/421 |
| 4,037,444 | 7/1977 | Ledebor et al. | 72/21 |
| 4,062,213 | 12/1977 | Schneider et al. | 72/24 |
| 4,120,185 | 10/1978 | Schneider et al. | 72/23 |
| 4,206,620 | 6/1980 | Eaton | 414/431 |

OTHER PUBLICATIONS

Cold Pilgering of Tubes, publication of Demag Meer Co., West Germany (no date).

*Primary Examiner*—Lowell A. Larson
*Assistant Examiner*—Jorji M. Griffin
*Attorney, Agent, or Firm*—Burns, Doane, Swecker & Mathis

[57] ABSTRACT

A cold pilger mill including a rolling mechanism for intermittently rolling a tubular material over a mandrel to a reduced-diameter pipe. A detector is associated with the rolling mechanism for detecting the rolling phase in the rolling mechanism. A feeding mechanism for feeding the material in the axial direction and a turning mechanism for turning the material and the mandrel are respectively provided with their own motors. A controller is also provided to receive a signal from the detector and supply operation signals to the respective motors of the feeding mechanism and the turning mechanism so that these mechanisms are operated at completion of each rolling stroke.

8 Claims, 7 Drawing Figures

COLD PILGER MILL

FIELD OF THE INVENTION

The present invention relates to a cold pilger mill, and more particularly to such a mill of a simple mechanical construction and easy in adjustment and maintenance.

DESCRIPTION OF THE PRIOR ART

It is well-known to use cold pilger mills as the means of manufacturing small-diameter seamless pipes of close tolerances. Briefly describing the principle of the cold pilgering process, as shown in FIG. 1 a starting tubular material 10 is intermittently fed over a tapered mandrel 12 from its base end towards its tip end, and each time the material 10 is stationary with respect to the mandrel 12 a pair of grooved dies or rolls 14 which embrace the material 10 from above and below are reciprocated once along the tapered portion of the mandrel 12 from its base end X to its tip end Y for rolling the material 10 to a reduced diameter and wall thickness pipe 16. This cold-pilgering process is advantageous over the other seamless pipe manufacturing processes since a large cross-sectional area reduction, namely, large diameter and wall thickness reductions can be achieved, with the result of very high efficiency of pipe production. In addition, it is possible to produce pipes with greatly reduced eccentricities and closer tolerances in inner diameter, outer diameter and wall thickness.

As seen from the above, the cold pilgering process itself is not so complicated. However, the actual machines for carrying out this process have had to be very complicated in order to ensure that at each reciprocation of the grooved rolls, i.e., at the completion of each rolling stroke, the material 10 is axially advanced a predetermined distance and at the same time the material 10 and the mandrel 12 are turned around their longitudinal axes by a predetermined angle.

One example of such conventional cold pilger mills is schematically shown in FIG. 2. The shown cold pilger mill comprises one main motor 20 as a driving source, which is adapted to rotate a crank shaft 22 at a constant speed through a chain-and-wheel mechanism $\mathbf{20}_a$. The crank shaft 22 has a pair of crank pins $\mathbf{22}_a$ which are in turn connected respectively to a pair of saddles 24 shown in chain-line in FIG. 2 through a coupling rod $\mathbf{22}_b$.

These saddles 24 have two grooved rolls 26, similar to those shown in FIG. 1, mounted on roll shafts $\mathbf{26}_a$ pivotally supported in the saddles. Each shaft $\mathbf{26}_a$ is firmly connected to a pinion $\mathbf{28}_a$ in mesh with a stationary rack $\mathbf{28}_b$ affixed to a saddle bed side plate (not shown).

With this arrangement, when the crank shaft 22 is rotated by the motor 20, the saddles 24 are reciprocated with the associated rolls 26, and at the same time the rolls 26 are reciprocatively rotated since the pinions $\mathbf{28}_a$ fixed to the rolls 26 are caused to move and rotate in meshed condition on and along the racks $\mathbf{28}_b$ by the reciprocation of the saddles 24. As a result, a starting tubular material (not shown) inserted over a tapered mandrel (not shown) and embraced between the pair of the grooved rolls 26 will be rolled by the reciprocating and rotating rolls 26 to a reduced diameter and wall thickness pipe. Therefore, the above arrangement constitutes a rolling mechanism.

The crank shaft 22 is connected through a gear train 30, a bevel gear mechanism 32, a line shaft 34 and another bevel gear mechanism 36 to a feed cam 38, so that the rotation of the shaft 22 is transmitted to the cam 38. This cam 38 is in contact with the rear end of a feed screw 40 which is in turn screwed through a feed carriage 42 slidable in the rolling direction. This feed carriage 42 is adapted to engage and push the rear end of a starting tubular material (not shown) towards the pair of rolls 26. In addition, the feed screw 40 has a gear 44 fixed thereto at such a position as to mesh with a driving gear $\mathbf{46}_a$ when the screw 40 is moved to the most foreward position, so that the feed screw 40 is rotated with respect to the feed carriage 42 by the gear $\mathbf{46}_a$ so as to be returned to its most rearward position keeping the carriage 42 in a stationary condition. The gear $\mathbf{46}_a$ is rotated through a gear train $\mathbf{46}_b$ by a gear box 48 which is driven by a gear 50 fixed to the line shaft 34.

With the above arrangement, upon each reciprocation of the saddles 24, i.e., at completion of each rolling stroke, the feed screw 40 is forwardly pushed by the feed cam 38 to advance the carriage 42 and hence the material toward the rolls 26 a predetermined distance.

When the feed screw 40 is moved to its most foreward position, the gear 44 meshes with the gear $\mathbf{46}_a$ and on the other hand the cam 38 is thereafter gradually separated from the rear end of the screw 40. Therefore, after the completion of the forward feed of the material, the screw 40 is rotated by the gear $\mathbf{46}_a$ to be returned to its rearmost i.e., its original position while maintaining the carriage 42 in the advanced position. Thus, the above arrangement constitutes a feeding mechanism.

The line shaft 34 has mounted on the rear end thereof a turning cam 52 adapted to push a cam follower 54 connected to the end of a transverse shaft 56. The transverse shaft 56 is spring-biased toward the cam 52 and has fixed to its other end a worm gear $\mathbf{58}_a$ which is in mesh with a worm wheel $\mathbf{58}_b$ mounted on the rear end of a turning shaft 60.

This turning shaft 60 has a gear $\mathbf{62}_a$ fixed thereto in mesh through a gear train $\mathbf{62}_b$ with a gear $\mathbf{62}_c$ mounted on a mandrel chuck 64 which is rotatably located behind the feed carriage 42. The turning shaft 60 also has another gear $\mathbf{66}_a$ mounted on a forward end thereof in mesh through a gear train $\mathbf{66}_b$ with a gear $\mathbf{66}_c$ fixed to an entry pipe turning chuck 68, which is rotatably located between the feed carriage 42 and the saddle 24. The gear $\mathbf{66}_a$ is also in mesh through a gear train $\mathbf{66}_d$ with a gear $\mathbf{66}_e$ mounted on an exit pipe turning chuck 70, which is rotatably located at the side of the saddles 24 opposite to the entry turning chuck 68.

The mandrel (not shown) is set in such a manner as to be grasped at its tail end by the mandrel chuck 64 and extends through a hole in the feed carriage 42 and the entry pipe turning chuck 68 so that its tapered portion is located between the pair of rolls 26. On the other hand, the starting tubular material to be rolled is set over the mandrel in such a manner that the material is rotatably supported and abutted at its rear end by the feed carriage 42 and is axially movably but unrotatably grasped by the entry and exit pipe turning chucks 68 and 70.

With the above construction, at completion of each rolling stroke, the turning cam 52 pushes the transverse shaft 56 and hence the worm gear $\mathbf{58}_a$, so as to rotate the worm wheel $\mathbf{58}_b$ and hence the turning shaft 60. This rotation of the turning shaft 60 is transmitted to the mandrel chuck 64, the entry pipe turning chuck 68 and the exit pipe turning chuck 70 through the gears $\mathbf{62}_a$, $62_b$, $62_c$, $66_a$, $66_b$, $66_c$, $66_d$ and $66_e$, so that the mandrel and the material held by these chucks are turned for example about 60 to 90 degrees. Thus, this arrangement constitutes a turning mechanism.

As seen from the above, the conventional cold pilger mill uses a very complicated arrangement in order to make the feeding of the material and the turning of the material and mandrel in precise synchronism with the intermittent rolling operation. However, the elements excluding the motor 20, the crank shaft 22, the saddles 24, the rolls 26, the feed carriage 42, the mandrel chuck 64, and the entry and exit pipe turning chucks 68 and 70, are provided only for power transmission. In other words, a considerable portion of the conventional cold pilger mill is constituted by the power transmission mechanism attendant to the above mentioned main elements, and since the transmission mechanism is very complicated, the overall construction of the pilger mill has become very complicated.

In addition, the above mentioned complication causes another problem when the mandrel and the grooved rolls are replaced in order to change the diameter and/or the wall thickness of the seamless pipe to be produced. Namely, it is necessary to change and adjust many gears and cams without upsetting the synchronism among the rolling, feeding and turning operations. This is very troublesome, and will also appear in change of operation mode such as change in the turning angle of the chucks 64, 68 and 70.

SUMMARY OF THE INVENTION

Accordingly, it is an object of the present invention to provide a cold pilger mill having a very simple power transmission mechanism.

It is another object of the present invention to provide a cold pilger mill which can relatively easily comply with changes in the dimensions of the product and changes in operation mode.

The above and other objects of the present invention are accomplished by a cold pilger mill comprising: a rolling mechanism for intermittently rolling a tubular material over a mandrel to a reduced diameter pipe, said rolling mechanism including a pair of grooved rolls respectively rotatably supported by a pair of saddles and adapted to embrace said tubular material from opposite sides thereof, said saddles being reciprocated by a crank shaft rotated by a motor, each of said grooved rolls having fixed thereto a pinion in mesh with a stationary rack for rotation with the roll; a detector associated with said rolling mechanism for detecting the rolling phase in said rolling mechanism; a feeding mechanism provided with its own motor for feeding said material in the axial direction; a turning mechanism provided with its own motor for turning said material and said mandrel; and a controller receiving a signal from said detector and supplying an operation signal to the respective motors of said feeding mechanism and said turning mechanism so that said mechanisms are operated at completion of each rolling stroke.

Ordinarily, said turning mechanism is constituted by a mandrel chuck for grasping the tail end of said mandrel, and entry and exit pipe turning chucks located at opposite sides of said saddles in the rolling direction for holding said material. Preferably, each of said chucks is provided with one separate and independent motor. In addition, said detector may be a rotational angle detector adapted to generate a pulse signal for each predetermined amount of angular displacement.

In one embodiment of the present invention, each of said motors other than the motor associated with said rolling mechanism is a pulse motor, and said controller is adapted to respectively supply predetermined numbers of power pulses to said pulse motors at completion of each rolling stroke in response to the signal from said detector. In this embodiment, preferably, said controller includes a pulse generator and preset counters adapted to count the pulses to be supplied to each of said pulse motors. Said controller is adapted to supply the power pulses until the respective counters reach predetermined count values.

In another embodiment of the present invention, each of said motors other than the motor of said rolling mechanism is associated with a rotational angle detector and a local controller, and said main controller is adapted to supply an operation signal to each local controller at completion of each rolling stroke in response to the signal from said rolling phase detector. Each of said local controllers operates to put the associated motor in operating condition in response to said opertion signal from said main controller, and to monitor the output from the associated rotational angle detector so as to stop said associated motor when the associated motor has rotated a predetermined amount.

The above and other objects and features of the present invention will become apparent from the following detailed description of preferred embodiments with reference with the accompanying drawings:

DETAILED DESCRIPTION

Figure 3:
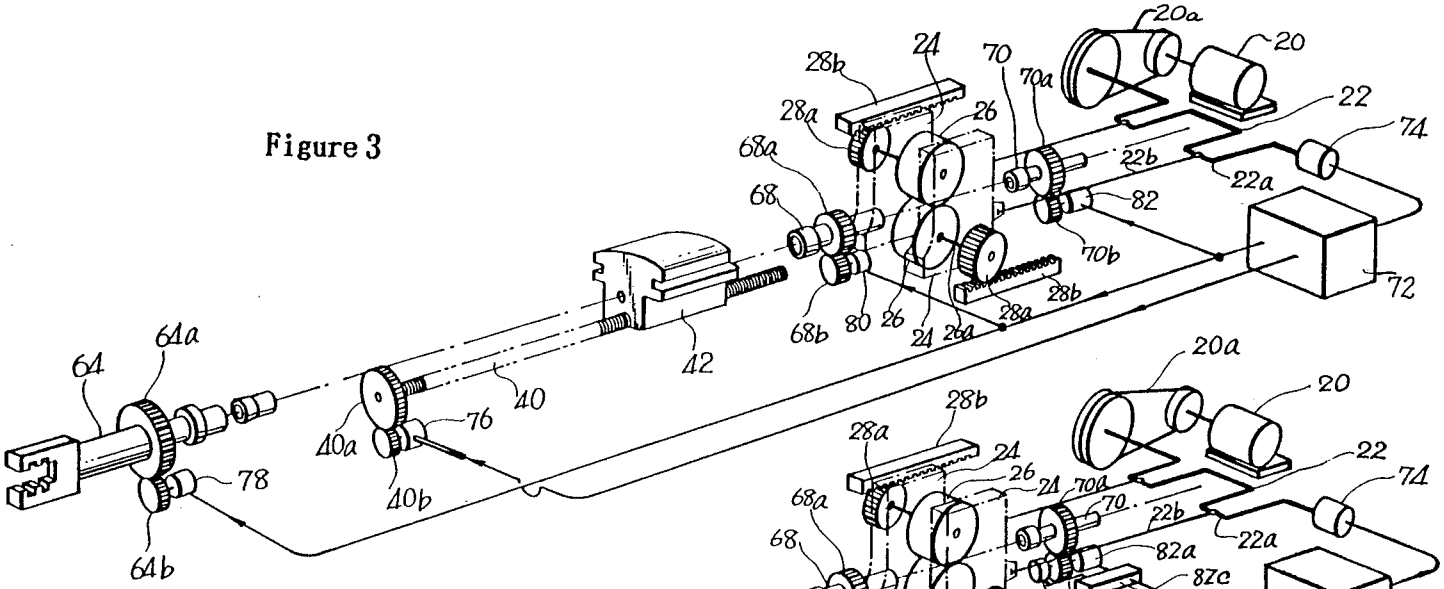
FIG. 3 is a schematic perspective view of the overall construction of a first embodiment of the cold pilger mill constructed in accordance with the present invention.

Referring to FIG. 3, there is shown a schematic perspective view of a first embodiment of the cold pilger mill in accordance with the present invention. In FIG. 3, portions similar to those shown in FIG. 2 are given the same Reference Numerals.

Figures 1, 2:
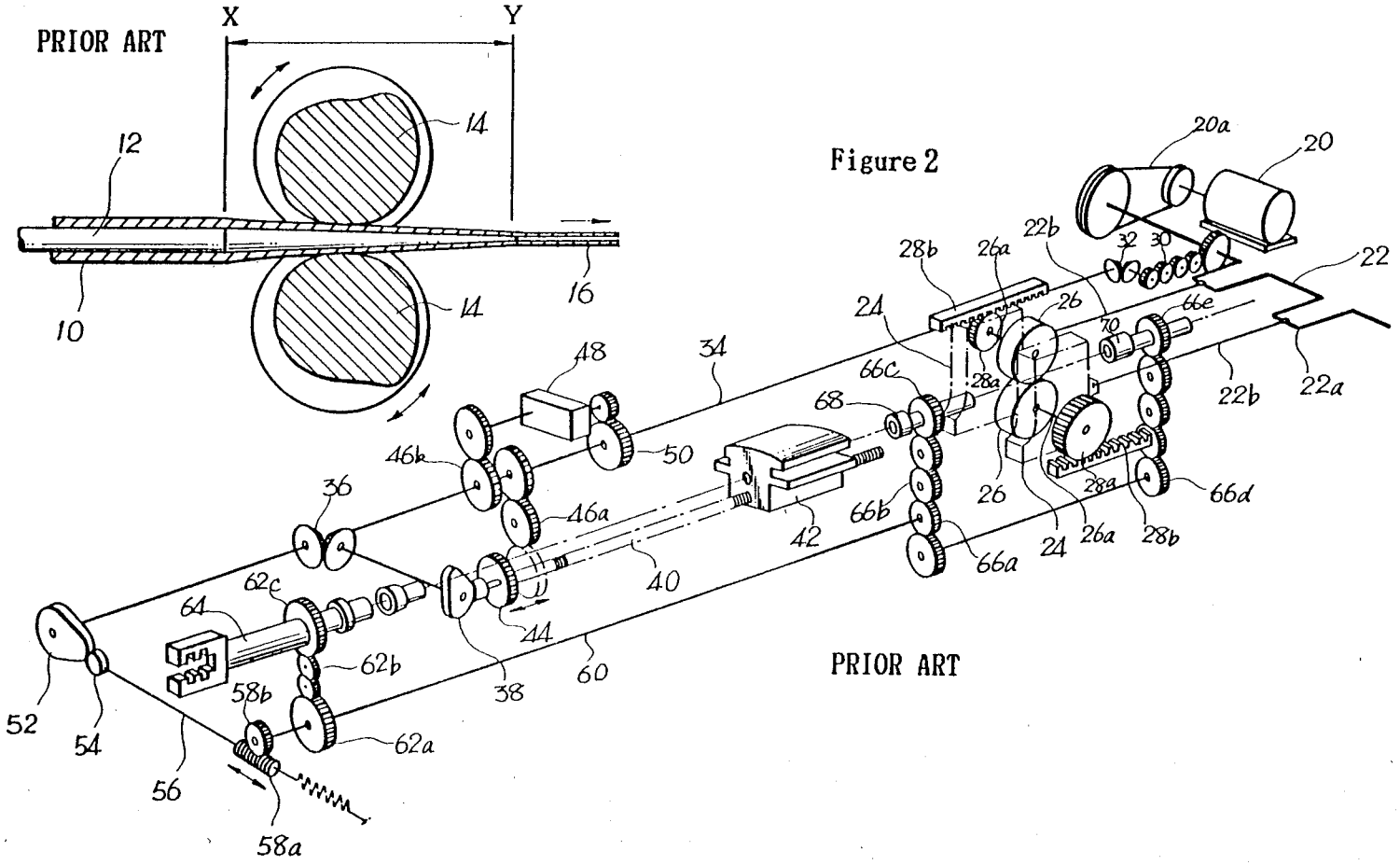
Figure 1 PRIOR ART
Figure 2 PRIOR ART
FIG. 1 illustrates the principle of operation of the cold pilgering process.
FIG. 2 is a schematic perspective view showing the overall construction of a conventional cold pilger mill.

The shown cold pilger mill comprises a rolling mechanism, a feeding mechanism and a turning mechanism as in the conventional mill shown in FIG. 2, and in addition has a controller 72 for synchronizing operations of the feeding and turning mechanisms with the operation of the rolling mechanism.

The rolling mechanism comprises one main motor 20 adapted to rotate a crank shaft 22 at a constant speed through a chain-and-wheel mechanism $20_a$. The crank shaft 22 has a pair of crank pins $22_a$ which are in turn connected to a pair of saddles 24 shown in chain-line in FIG. 3, respectivey, through a coupling rod $22_b$. These saddles 24 have two grooved rolls 26, similar to those shown in FIG. 1, mounted on roll shafts $26_a$ pivotally supported in the saddles. The roll shaft $26_a$ is firmly connected to a pinion $28_a$ in mesh with a stationary rack $28_b$ affixed to a saddle bed side plate (not shown).

With this arrangement, when the crank shaft 22 is rotated by the motor 20, the saddles 24 are reciprocated with the associated rolls 26 between the advanced limit X and the retreated limit Y, and at the same time the rolls 26 are reciprocatively rotated since the pinions $28_a$ fixed to the rolls 26 are caused to move and rotate in meshed condition on and along the racks $28_b$ by the reciprocation of the saddles 24. As a result, a starting tubular material (not shown) inserted over a tapered mandrel (not shown) and embraced between the pair of the grooved rolls 26 will be rolled when the rolls 26 are moved from the advanced limit X to the retreated limit Y. On the other hand, when the rolls 26 are returned from the retreated limit Y to the advanced limit X, since the portion of the material surrounding the tapered portion of the mandrel has already been reduced, that portion of the material is then not rolled by the rolls 26. In other words, the rolls will merely trace the just rolled portion of the material.

The above construction is the same as that of the rolling mechanism of the conventional pilger mill. In addition, the rolling mechanism of the shown embodiment has a rotational angle detector 74 coupled to the crank shaft 22. This rotational angle detector 74 is provided to detect from the rotational angle of the crank shaft 22 the phase of rolling, i.e., what stage of each rolling stroke the mill is presently in. In other words, the phase of rolling is detected for recognizing where the saddles 24 are or where the grooved rolls 26 are in their rotational position. Therefore, the rolling phase detector may instead be a detector which directly detects the position of the saddles 24 or the rotational angle of the rolls 26. In the shown embodiment, the detector 74 is of the type which generates one pulse for each predetermined angular displacement. The detector 74 has an output connected to the controller 72.

The feeding mechanism includes a feed screw 40 threadedly received through a feed carriage 42 which is longitudinally movably located at the entry side of the saddles 24. The feed screw 40 is rotatably but axially immovably supported. The feed screw 40 has fixed to the rear end thereof a gear $40_a$ in mesh with a gear $40_b$ mounted on a rotating shaft of a pulse motor 76 which is controlled by the controller 72. Therefore, if the motor 76 is energized by the controller 72, the feed screw 40 is rotated through the gears $40_b$ and $40_a$ to forwardly and backwardly move the carriage 42 and the material to be rolled.

The turning mechanism is constituted by a mandrel chuck 64 adapted to grasp the tail end of a tapered mandrel as shown in FIG. 1, and entry and exit pipe turning chucks 68 and 70 located at opposite sides of the saddles 24 in the longitudinal, i.e., rolling direction. These turning chucks 68 and 70 are adapted to axially movably but unrotatably grasp the tubular material to be rolled.

The mandrel chuck 64 has a gear $64_a$ fixed thereto and in mesh with a gear $64_b$ mounted on a shaft of a pulse motor 78 which is controlled by the controller 72. Therefore, if the motor 78 is driven under the control of the controller 72, the mandrel chuck 64 is rotated to turn the mandrel (not shown) grasped by the chuck 64.

Similarly, the entry pipe turning chuck 68 has fixed thereto a gear $68_a$ in mesh with a gear $68_b$ driven by a pulse motor 80. Also, the exit pipe turning chuck 70 has fixed thereto a gear $70_a$ in mesh with a gear $70_b$ driven by a pulse motor 82. These pulse motors 80 and 82 are controlled by the controller 72. If the these motors 80 and 82 are energized under the control of the controller 72, these chucks 68 and 70 are turned.

Thus, if the pulse motors 76, 78, 80 and 82 are energized, the material to be rolled abutted by the carriage 42 and grasped by the pipe turning chucks 68 and 70 is advanced in the axial direction and turned around the longitudinal axis, and at the same time, the mandrel inserted in the material to be rolled is turned together with the material without being axially moved.

In order to control the pulse motors 76, 78, 80 and 82, the controller 72 receives the rotational angle signal from the detector 74 and outputs power pulse trains to the pulse motors 76, 78, 80 and 82 of the feeding and turning mechanisms. Specifically, the controller 72 receives pulses generated one for each predetermined amount of angular displacement by the rotational angle detector 74 coupled to the crank shaft 22. When the number of the pulses received reaches a predetermined number, the controller 72 decides that one actual rolling stroke has been completed, i.e., that the rolls 26 have returned to a position just before the advanced limit X. Thereafter, during the so-called idle period from the completion of each actual rolling stroke to the start of the next actual rolling stroke, i.e., during the period from the time just before the rolls 26 are returned to the advanced limit X to the time just after the rolls 26 starts to move from the advanced limit X, the controller 72 supplies to the pulse motor 76 of the feeding mechanism a predetermined number of power pulses (Na) necessary to advance the carriage 42 and hence the material to be rolled (not shown) a predetermined distance in the material feeding direction. At the same time, the controller 72 supplies to the pulse motors 78, 80 and 82 of the turning mechanism another predetermined number of power pulses (Nb) required for turning the chucks 64, 68 and 70 and hence the mandrel and the material to be rolled (both not shown) by a predetermined angle. In addition, the controller 72 is adapted to freely move the carriage 42 in accordance with an external input.

Figure 4:
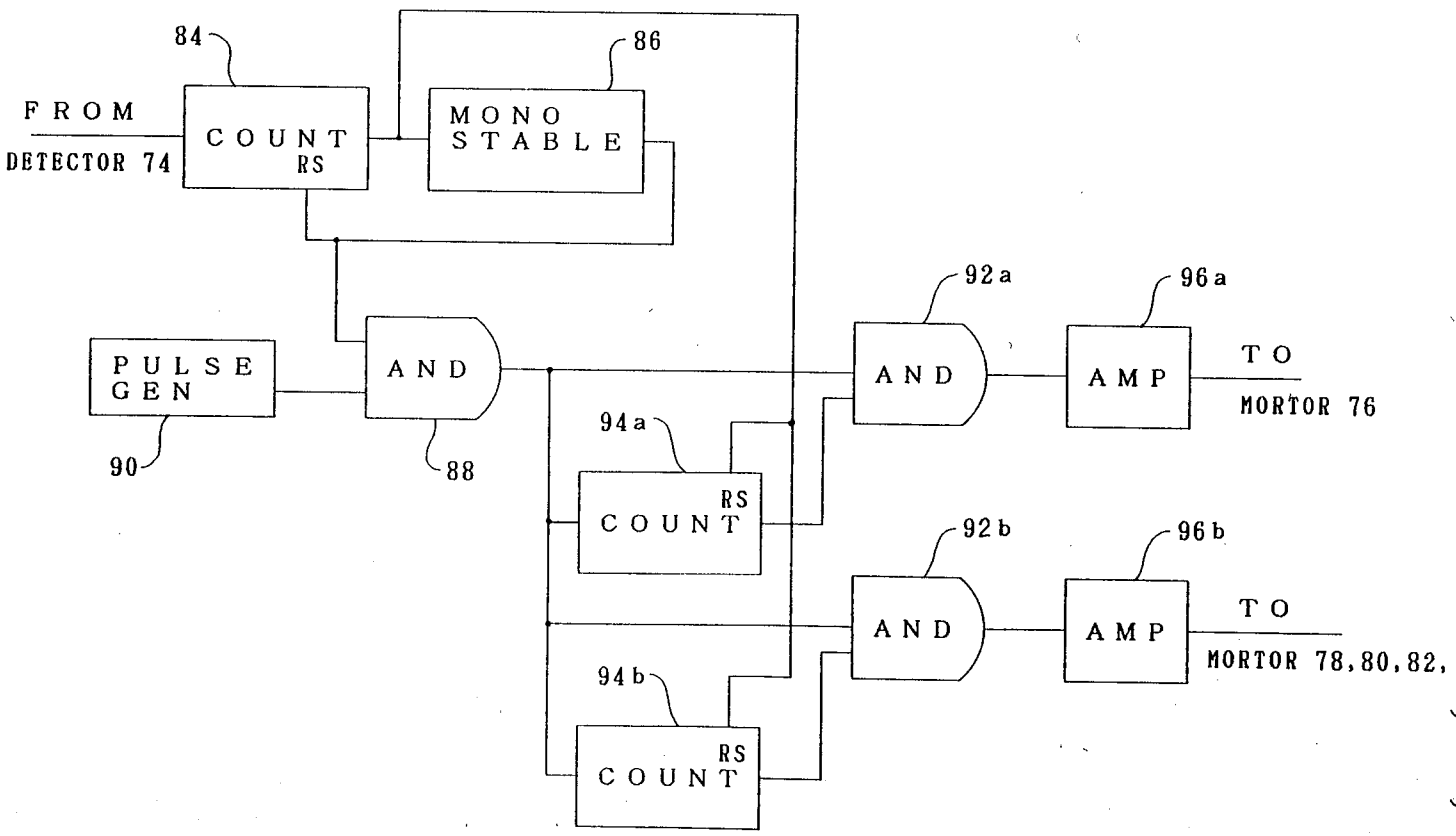
FIG. 4 is a block diagram showing the construction of a controller in the cold pilger mill shown in FIG. 3.
Figure 7:
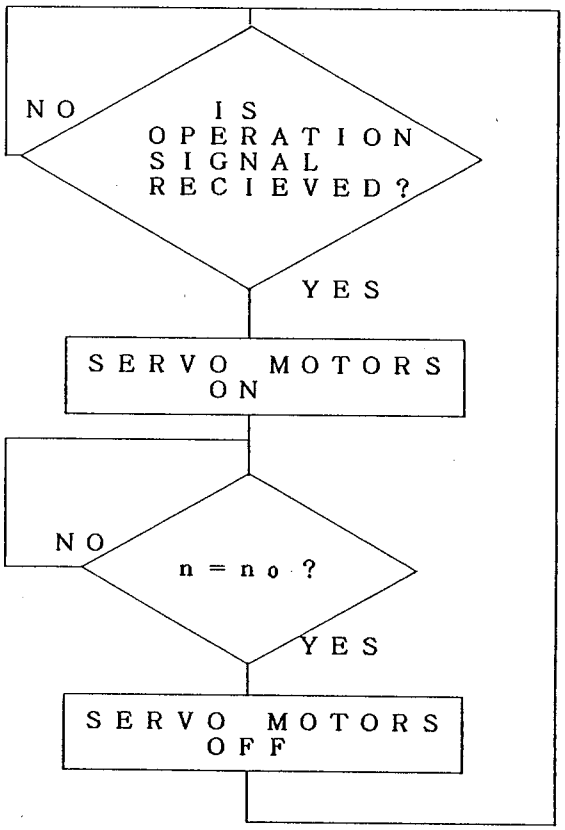
FIG. 7 is a flow chart illustrating the control of the local controller in FIG. 5.

Referring to FIG. 4, there is shown one example of the construction of the controller 72 in the form of a block diagram. The shown controller 72 comprises a preset counter 84 having an input connected to the rotational angle detector 74, so that the counter 84 counts pulses outputted from the rotational angle detector 74. This counter 84 has an output connected to a monostable circuit 86, so that when the counter 84 counts up to a predetermined number $N_R$ corresponding to one rolling stroke, the counter 84 triggers the monostable circuits 86.

The monostable circuit 86 has an output connected to a reset terminal of the counter 84 and one input of an AND gate 88, so that when the monostable circuit 86 is triggered, it outputs a logical-high signal to the AND gate 88 so as to open the AND gate 88 and resets the counter 84 by the leading edge of the logical-high signal. The AND gate 88 has another input connected to a pulse generator 90 and an output connected to one input of AND gates $92_a$ and $92_b$ and preset counters $94_a$ and $94_b$. The AND gate $92_a$ has an output connected to an amplifier $96_a$ whose output is connected to the pulse motor 76 of the feeding mechanism. The AND gate $92_b$ has an output connected to another amplifier $96_b$ whose output is connected to the pulse motors 78, 80 and 82 of the turning mechanism.

The AND gates $92_a$ and $92_b$ have another input connected to the output of preset counters $94_a$ and $94_b$, respectively. These preset counters $94_a$ and 94are reset by the leading edge of the logical-high signal outputted from the counter 84 when the counter 84 counts to the aforementioned predetermined number $N_R$. The preset counter $94_a$ is adapted to supply a logical-high signal to the associated AND gate $92_a$ so as to open it until the counter reaches the aforemention predetermined count number Na. After the counter $94_a$ reaches the predetermined count Na, it supplies a logical-low signal to the AND gate $92_a$ so as to close the AND gate $92_a$. Therefore, Na pulses are fed from the AND gate 88 through the AND gate $92_a$ to the amplifier $96_a$, so that the amplifier $96_a$ supplies Na power pulses to the pulse motor 76 of the feeding mechanism.

Similarly, the counter $94_b$ is adapted to supply a logical-high signal to the associated AND gate $92_b$ so as to open it until the counter $94_b$ reaches the aforementioned predetermined count number Nb. After the counter $94_b$ reaches the predetermined count Nb, it supplies a logical-low signal to the AND gate $92_b$ so as to close the AND gate $92_b$. Therefore, Nb pulses are fed from the AND gate 88 through the AND gate $92_b$ to the amplifier $96_b$, so that the amplifier $96_b$ supplies Nb power pulses to the pulse motors 78, 80 and 82 of the turning mechanism.

Next, explanation will be made on operation of the above mentioned cold pilger mill.

First of all, a tapered mandrel as shown in FIG. 1 is set by grasping the tail end of the mandrel by the mandrel chuck 64 and locating the tapered portion of the mandrel between the rolls 26. The feed carriage 42 is returned to its retreated limit by inputting an external command to the controller 72. In such a condition, a starting tubular material to be rolled (not shown) is set by bringing the tail end of the material into abutment with the carriage 42, passing the forward portion of the material through the entry turning chuck 68 between the rolls 26, and unrotatably but axially movably grasping the material by the entry and exit turning chucks 68 and 70.

After the aforementioned preparation is completed, the motor 20 is brought into an energized condition. This rotation of the motor 20 causes the rotation and reciprocation of the rolls 26 between the advanced limit X and the retreated limit Y so that the material is intermittently rolled at a constant cycle.

Namely, when the rolls 26 is moved from the advanced limit X to the retreated limit Y, the material is actually rolled. On the other hand, when the rolls 26 are moved from the retreated limit Y to the advanced limit X, the just rolled portion of the material is merely traced by the rolls 26.

When the mill is in a rolling condition as mentioned above, the preset counter 84 of the controller 72 counts the pulse signals generated by the rotational angle detector 74. When the counted value of the counter 84 reaches the predetermined number $N_R$ corresponding to the time for one rolling stroke, the counter 84 outputs a logical-high signal to the preset counters $94_a$ and $94_b$ and the monostable circuit 86. As a result, the counters $94_a$ and $94_b$ are reset to be ready to count inputted pulses and also to supply a logical-high signal to the associated AND gates $92_a$ and $92_b$ so as to open the same AND gates. One the other hand, the monostable circuit 86 outputs a logical-high signal to the counter 84 to reset the same counter so that it starts counting from its initial count value again.

At the same time, the logical-high signal from the monostable circuit 86 is fed to the AND gate 88 to open the same AND gate, so that the pulses are fed from the pulse generator 90 through the AND gate 88 to the AND gates $92_a$ and $92_b$ and the counters $94_a$ and $94_b$. Since the counter $94_a$ is adapted to output the logical-high signal to the associated AND gate $92_a$ so as to maintain the same AND gate in the open condition until the counted value reaches the predetermined value Na, the predetermined number of pulses Na are supplied from the pulse generator 90 through the AND gates 88 and $92_a$ to the amplifier $96_a$ where they are amplified to be fed as power pulses to the pulse motor 76. Also, since the counter $94_b$ is adapted to output the logical-high signal to the associated AND gate $92_b$ so as to maintain the same AND gate in the open condition until the counted value reaches the predetermined value Nb, the predetermined number of pulses Nb are supplied from the pulse generator 90 through the AND gates 88 and $92_b$ to the amplifier $96_b$ where they are amplified to be fed as power pulses to the pulse motors 78, 80 and 82.

Thus, during each idle period from the completion of one rolling stroke to the start of the next rolling stroke, the controller 72 supplies the predetermined numbers of power pulses Na and Nb to the motor 76 of the feeding mechanism and the motors 78, 80 and 82 of the turning mechanism, respectively, so that the feed carriage 42 is advanced toward the saddles 24 the predetermined distance and at the same time the mandrel chuck 64, the entry pipe turning chuck 68 and the exit pipe turning chuck 70 are turned the predetermined amount of angle. In other words, during the idle period in which the rolls 26 are turned back at the advanced limit X, since the material to be rolled is free from the restraint of the rolls 26, the material to be rolled is advanced the predetermined distance by the carriage 42, and the material and the mandrel are turned together by the predetermined angle by the chucks 64, 68 and 70. Accordingly, the material is intermittently rolled by predetermined lengths while changing the rolling direction in each rolling stroke.

If the rolling is performed as mentioned above and is completed, the carriage 42 is moved to its retreated limit by inputting an external command to the controller 72, and then the next tubular material is set in the aforementioned manner. Thus, a number of starting tubular materials are sequentially rolled.

In the first embodiment shown in FIGS. 3 and 4, the AND gate $92_b$, the preset counter $94_b$ and the applifier $96_b$ are provided common to the pulse motors 78, 80 and 82 of the turning mechamism. However, if each of motors 78, 80 and 82 is individually associated with one set of the AND gate $92_b$, the preset counter $94_b$ and the amplifier $96_b$, even if the gear pairs $64a$ and $64_b$, $68_a$ and $68_b$, and $70_a$ and $70_b$ are different in gear ratio, the chucks 64, 68 and 70 can be easily synchronized by adjusting the preset values of the three respective counters $94_b$.

Figure 5:
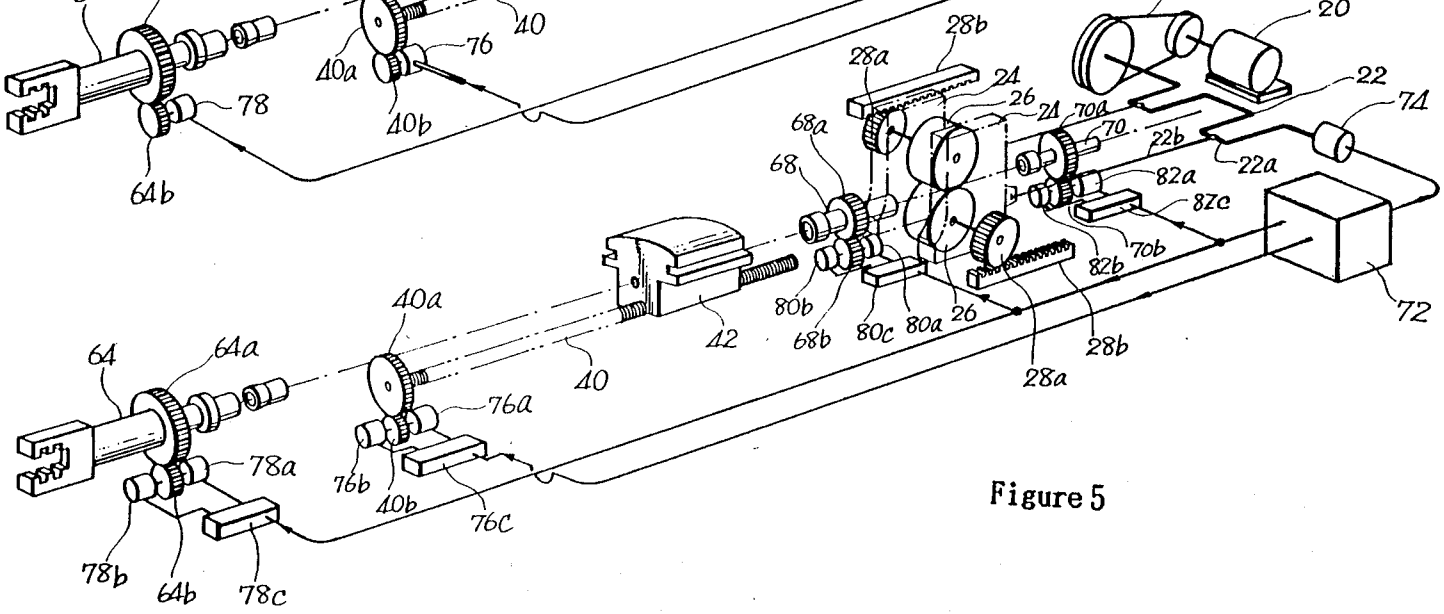
FIG. 5 is a view similar to FIG. 3 but showing a second embodiment of the present invention.

Referring to FIG. 5, there is shown a second embodiment of the cold pilger mill in accordance with the present invention. Portions shown in FIG. 5 similar to those of the first embodiment shown in FIG. 3 are given the same Reference Numerals and explanation of those portions will be omitted.

In the second embodiment, instead of the pulse motors 76, 78, 80 and 82, servo motors $76_a$, $78_a$, $80_a$ and $82_a$ are coupled to the gears $40_b$, $64_b$, $68_b$ and $70_b$, respectively, and are also associated with rotational angle detectors $76_b$, $78_b$, $80_b$ and $82_b$, respectively. These servo motors $76_a$, $78_a$, $80_a$ and $82_a$ and the rotational angle detectors $76_b$, $78_b$, $80_b$ and $82_b$ are connected to local controllers $76_c$, $78_c$, $80_c$ and $82_c$, respectively, which are adapted to operate the associated servo motors $76_a$, $78_a$, $80_a$ and $82_a$ in response to the operation signal from the controller 72 and at the same time to count a pulse signal generated by the associated rotational detectors $76_b$, $78_b$, $80_b$ and $82_b$ for each predetermined angular displacement. When the respective count values reach respective predetermined values, the local controllers operate to stop the associated servo motors.

In this second embodiment, on the other hand, the controller 72 counts the pulse signals from the rotational angle detector 74 coupled to the crank shaft 22 and outputs the operation signal to each of the local controllers $76_c$, $78_c$, $80_c$ and $82_c$. In addition, the controller 72 counts the operation signals outputted to compute the number of the rolling strokes performed N, and outputs a rolling completion signal when N reaches a predetermined value No.

Figure 6:
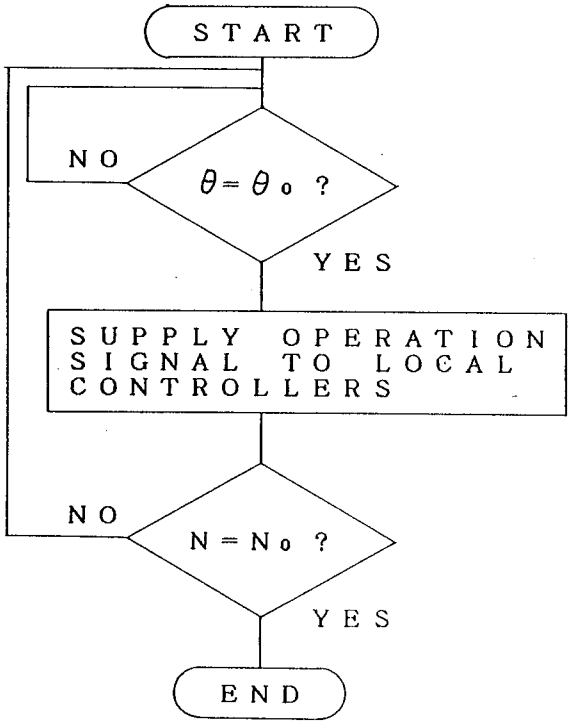
FIG. 6 is a flow chart illustrating the control of the main controller in FIG. 5.

The cold pilger mill of the second embodiment operates as follows: Similarly to the first embodiment, a starting tubular material (not shown) is set in the mill, and then, the main motor 20 is put in an operating condition to start the rolling. In this condition, every time the controller 72 receives the counts a pulse signal from the rotational angle detector 74, it determines whether or not the count value has reached a predetermined number, i.e., whether or not the rotational angle $\theta$ of the crank shaft 22 has reached a predetermined degree of angle $\theta_o$, as shown in the flow chart of FIG. 6. When the rotational angle $\theta$ reaches the predetermined angle $\theta_o$, the controller 72 outputs an operation signal to the local controllers $76_c$, $78_c$, $80_c$ and $82_c$. At the same time, the controller 72 counts up the number of rolling strokes performed N by 1 and starts to count again the pulse signal from the detector 74 until the number of rolling strokes reaches the predetermined value No.

In response to the operation signal from the controller 72, the local controllers $76_c$ $78_c$, $80_c$ and $82_c$ bring the associated servo motors $76_a$, $78_a$, $80_a$ and $82_a$ into operating condition, respectively, and at the same time start to count a pulse signal from the respective associated rotational angle detectors $76_b$, $78_b$, $80_b$ and $82_b$. In each of the local controllers, when the count value "n" reaches the predetermined count value "$n_o$" the local controller stops the associated servo motor. Thus, the feed carriage 42 is advanced toward the saddles 24 the predetermined distance by the servo-motor $76_a$, and at the same time, the chucks 64, 68, and 70 are turned by the predetermined angle by the servo motors $78_a$, $80_a$ and $82_a$. Accordingly, the material is intermittently rolled by the predetermined lengths while changing the rolling direction in each idle period in which the material is free from the restraint of the rolls 26.

In the second embodiment as mentioned above, the local controllers $76_c$, $78_c$, $80_c$ and $82_c$ are used. However, these local controllers may be omitted so that the controller 72 directly receives the output of the rotational angle detectors $76_b$, $78_b$, $80_b$ and $82_b$ and directly controls the servo motors $76_a$, $78_a$, $80_a$ and $82_a$.

Comparing the cold pilger mills in accordance with the present invention as explained above with the conventional cold pilger mill as shown in FIG. 2, it will be noted that the mill of the present invention requires the rotational angle detector 74, the driving pulse motors 76, 78, 80 and 82, the controller 72, and, in the second embodiment, also the local controllers $76_c$, $78_c$, $80_c$ and $82_c$, but does not require the power transmission means such as the bevel gear 32, the line shaft 34, the bevel gear mechanism 36, the feed cam 38, the gear box 48, the turning cam 52, and the like which are required in the conventional mill. Therefore, the mill of this invention is very simple in construction in comparision with the conventional mill. This simplicity in construction makes the mill inexpensive and maintenance easy.

Specifically, the feeding mechanism in the conventional cold pilger mill is such that the carriage 42 is advanced together with the feed screw 40 by the feed cam 38 and after the carriage 42 is advanced only the feed screw 40 is returned to its original position by rotating the screw 40 while maintaining the carriage 42 in the advanced position. In other words, the feeding mechanism of the conventional mill requires advancing means and returning means.

On the other hand, in the cold pilger mills of the present invention, the feed mechanism is such that the carriage 42 can be intermittently advanced only by turing the feed screw 40. Therefore, the feed mechanism in the present invention is extremely simple.

In addition, in the conventional mill, the feeding mechanism and the turning mechanism are driven by the motor of the rolling mechanism through mechanical coupling means which necessarily becomes complicated for ensuring synchronism between the mechanisms but inevitably has play or backlash between each pair of mechanical elements. The more the coupling mechanism becomes complicated, the larger the total amount of play or backlash in the coupling mechanism becomes. For this reason, the respective mechanisms cannot be so precisely synchronized by the complicated mechanical coupling means.

On the other hand, in the mill of the present invention, the feeding mechanism and the turning mechanism are separately driven by the respective individual motors independent of the motor for the rolling mechanism, so that the rolling mechanism, the feeding mechanism and the turning mechanism are synchronized by electrical control means without use of mechanical coupling means. Since the electrical synchronism is free from the mechanical play or backlash in the mechanical couplings, all the mechanisms are precisely synchronized in the mill of the present invention.

Furthermore, the mill of the present invention eliminates a substantial portion of the power transmission mechanism required in the conventional mill, so that the power loss in the transmission system becomes substantially zero. Therefore, the efficiency of power ulitization is excellent and power costs can be reduced.

In addition, when the mandrel and/or the rolls 26 are exchanged in order to change the diameter and/or the wall thickness of the products or upon change of operation mode such as change in the incremental angular disclacement of the chucks, the synchronism between the feeding and turning mechanisms can be easily maintained only by changing the preset values of the counters $94_a$ and $94_b$ without exchange and adjustment of the gears and the cams with very troublesome operations, as in the conventional cold pilger mill.

As seen from the above, in the cold pilger mill in accordance with the present invention, the rolling mechanism, the feeding mechanism and the turning mechanism are not coupled by mechanical means but are driven by individual motors synchronized under electrical control.

Therefore, there are eliminated mechanical power transmission mechanisms which constitute a relatively large part of the conventional cold pilger mill. Thus, the mill of the present invention is very simple in overall construction, and accordingly is inexpensive and easy in adjustment and maintenance.

I claim:

1. A cold pilger mill comprising:

a rolling mechanism for intermittently rolling a tubular material over a mandrel to produce reduced diameter pipe, said rolling mechanism including a pair of grooved rolls rotatably supported by a pair of saddles, said grooved rolls being arranged to embrace said tubular material from opposite sides thereof, said saddles being reciprocated to define a material rolling stroke by a crank shaft rotated by a first motor, each of said grooved rolls having fixed thereto a pinion in mesh with a stationary rack for rotation with the respective roll;

a detector communicating with said rolling mechanism for detecting the rolling phase in said rolling mechanism;

a feeding mechanism driven by a second motor for feeding said tubular material in an axial direction;

a mandrel chuck driven by a third motor for grasping a tail end of said mandrel;

an entry turning chuck driven by a fourth motor, said turning chuck being located near an entry side of said saddles in the rolling direction of said saddles for holding said tubular material over said mandrel;

an exit turning chuck driven by a fifth motor, said exit turning chuck being located adjacent a side of said saddles opposite said entry turning chuck in the rolling direction of said saddles for holding said tubular material over said mandrel; and a main controller receiving signal input from said detector and supplying an operation signal to the respective motors of said feeding mechanism, said mandrel chuck and said turning chucks so that said feeding mechanism and said chucks are operated upon completion of each rolling stroke.

2. A mill as set forth in claim 1, wherein each of said second, third, fourth and fifth motors is a pulse motor, and said main controller provides predetermined numbers of power pulses to said pulse motors upon completion of each rolling stroke in response to signal input from said detector.

3. A mill as set forth in claim 2, wherein said main controller includes a pulse generator and preset counters for counting the number of pulses to be supplied to each of said pulse motors, said main controller providing power pulses until the respective counters reach predetermined count values.

4. A mill as set forth in claim 1, wherein each of said second, third, fourth and fifth motors communicates with a rotational angle detector and a local controller, and wherein said main controller provides an operation signal to each local controller upon completion of each rolling stroke in response to signal input from said rolling phase detector, each of said local controllers being operative to place the motor associated therewith in an operating condition responsive to said operation signal from said main controller and to monitor output from the associated rotational angle detector so as to stop said associated motor when the associated motor rotates a predetermined amount.

5. A mill as set forth in claim 1 in which said detector is a rotational angle detector adapted to generate a pulse signal for each predetermined amount of angular displacement.

6. A mill as set forth in claim 5, wherein each of said second, third, fourth and fifth motors is a pulse motor, and said controller supplies predetermined numbers of power pulses to each of said pulse motors upon completion of each rolling stroke in response to signal input from said detector.

7. A mill as set forth in claim 6, wherein said controller includes a pulse generator and preset counters for counting pulses to be supplied to each of said pulse motors, said controller supplying power pulses until the respective counters reach predetermined count values.

8. A mill as set forth in claim 5, wherein each of said second, third, fourth and fifth motors communicates with a rotational angle detector and a local controller, and said main controller provides an operation signal to each local controller upon completion of each rolling stroke in response to signal input from said rolling phase detector, each of said local controllers being operative to place the motor associated therewith in an operating condition in response to said operation signal from said main controller and to monitor output from the associated rotational angle detector so as to stop said associated motor when the associated motor rotates a predetermined amount.

* * * * *